US005671623A

United States Patent [19]

Hsu

[11] Patent Number: 5,671,623

[45] Date of Patent: Sep. 30, 1997

[54] LOCK ASSEMBLY WITH A CURVED KEYWAY AND A FLEXIBLE KEY FOR ACTUATION THEREOF

[76] Inventor: Yun-Tung Hsu, 5F, No. 32, Sec. 4, Cheng-Kung Rd., Taipei City, Taiwan

[21] Appl. No.: 566,874

[22] Filed: Dec. 4, 1995

[51] Int. Cl.[6] ..... E05B 9/04

[52] U.S. Cl. ..... 70/375; 70/399; 70/419; 70/453; 70/407

[58] Field of Search ..... 70/375, 395, 397, 70/399, 407, 409, 418, 419, 453, 454, 358, 389

[56] References Cited

U.S. PATENT DOCUMENTS

| | | | |
|---|---|---|---|
| 2,044,381 | 6/1936 | Denull | 70/453 X |
| 3,343,386 | 9/1967 | Hall | 70/454 X |
| 3,465,556 | 9/1969 | McIlvenny | 70/454 X |
| 3,478,549 | 11/1969 | Schlage | 70/453 X |
| 3,494,159 | 2/1970 | Greenwald | 70/454 X |
| 4,111,019 | 9/1978 | Rabinow | 70/419 X |
| 4,599,877 | 7/1986 | Rabinow | 70/419 X |
| 5,086,632 | 2/1992 | Hsu | 70/399 X |
| 5,131,247 | 7/1992 | Hsu | 70/399 X |

*Primary Examiner*—Suzanne Dino

*Attorney, Agent, or Firm*—Townsend and Townsend and Crew LLP

[57] ABSTRACT

A lock assembly includes a lock and a flexible key. The lock includes a lock and an elongated plug unit having a longitudinal curved keyway that is accessible by the key. The keyway has several turns and several branch slots, each of which extends from one of the turns of the curved keyway in a direction different from that of a portion of the curved keyway succeeding the turn so as to mislead an undesirable flexible stick into the slot.

9 Claims, 11 Drawing Sheets

LOCK ASSEMBLY WITH A CURVED KEYWAY AND A FLEXIBLE KEY FOR ACTUATION THEREOF

BACKGROUND OP THE INVENTION

1. Field of the Invention

The invention relates to a lock assembly, more particularly to a lock assembly which includes a lock with a curved keyway, and a flexible key.

2. Description of the Related Art

In U.S. Pat. No. 5,086,632, the applicant disclosed a lock assembly (see FIGS. 1 to 4) which includes a lock with a curved keyway, and a flexible key that can be inserted into the curved keyway so as to manipulate the tumblers thereof. The flexible key includes a chain of successively hinged knuckles which are capable of respectively rotating about parallel axes so as to pass into the keyway. The chain includes a plurality of pivots each of which interconnects an adjacent pair of the knuckles.

Some points of the above-mentioned lock assembly that have room for improvement are as follows:

(I) Referring to FIG. 3, the curved keyway 14 formed in the plug unit of the lock is accessible by means of a flexible picking stick other than the flexible key so as to remove the spring-loaded tumblers 12 (see FIG. 2) from the keyway 14, thereby opening the lock. Thus, picking of the lock assembly is still possible.

(II) As illustrated in FIGS. 1 and 4, each of the knuckles 11 of the key 10 has a blind pivot hole unit 111 with a closed inner end section 111A and an open outer end section 111B, and an open-ended pivot hole unit 111C. Each of the pivots 15 includes a cylindrical solid shank 152 and an enlarged head 151. After the pivot 15 has been inserted into the blind pivot hole unit 111 of the left knuckle 11 and through the pivot hole unit 111C of the right knuckle 11, the enlarged head 151 of the pivot 15 is press-fitted within the open outer end section 111B of the blind pivot hole unit 111 while a clearance 111D is defined between the shank 152 of the pivot 15 and the wall which defines the pivot hole unit 111C, thereby causing deformation of the key 10. Furthermore, in assembly, the pivot 15 may be inserted into the blind pivot hole unit 111 in such a manner that axes thereof are not coaxial. In this case, the deformation of the key 10 also takes place. As a consequence, it is difficult to manipulate the tumblers 12 to unlock the lock with the use of the key 10, as shown in FIG. 2.

(III) Since the enlarged head 151 of the pivot 15 has a diameter almost equivalent to that of the open outer end section 111B of the blind pivot hole unit 11, great energy is required to push the head 151 of the pivot 15 into the knuckle 11, thereby inconveniencing the assembly thereof.

SUMMARY OF THE INVENTION

The main object of this invention is to provide a lock assembly which includes a plug unit with a curved keyway that is difficult to pick.

Another object of this invention is to provide a lock assembly which includes a flexible key consisting of a chain of hinged knuckles that can be assembled with ease.

Accordingly, the lock assembly of this invention generally includes a lock and a flexible key. The lock includes an elongated plug unit which has a longitudinal curved keyway that is accessible by the key. The keyway has several turns. The plug unit further has several branch slots, each of which extends from one of the turns of the curved keyway in a direction different from that of a portion of the curved keyway succeeding the turn so as to mislead an undesirable flexible stick into the slot.

The key includes a chain of successively hinged knuckles which can respectively rotate about parallel axes. Each of the knuckles has a blind pivot hole unit formed therein with a closed inner end section and an open outer end section, and an open-ended pivot hole unit formed through the knuckle. The chain includes a plurality of pivots, each of which interconnects an adjacent pair of the knuckles and each of which has an enlarged inner end portion that is received within the inner end section of the corresponding blind pivot hole unit of one of the knuckles in such a manner that the enlarged inner end portion has a section which is press-fitted within the inner end section of the blind pivot hole unit of the one of the knuckles, an enlarged outer end portion that is press-fitted within the outer end section of the blind pivot hole unit of the one of the knuckles and that has a greatest diameter slightly larger than that of the enlarged inner end portion of the pivot, and an intermediate portion that interconnects the enlarged inner and outer end portions and that extends through the open-ended pivot hole unit of another one of the knuckles. The intermediate portion of each of the pivots has a diameter smaller than that of the enlarged inner end portions of the pivots and than that of the open-ended pivot hole units of the knuckles to assist in relative rotation of any adjacent pair of knuckles.

BRIEF DESCRIPTION OF THE DRAWINGS

Other features and advantages of this invention will become more apparent in the following detailed description of the preferred embodiments with reference to the accompanying drawings, in which.

DETAILED DESCRIPTION OF THE PREFERRED EMBODIMENTS

Figure 1:
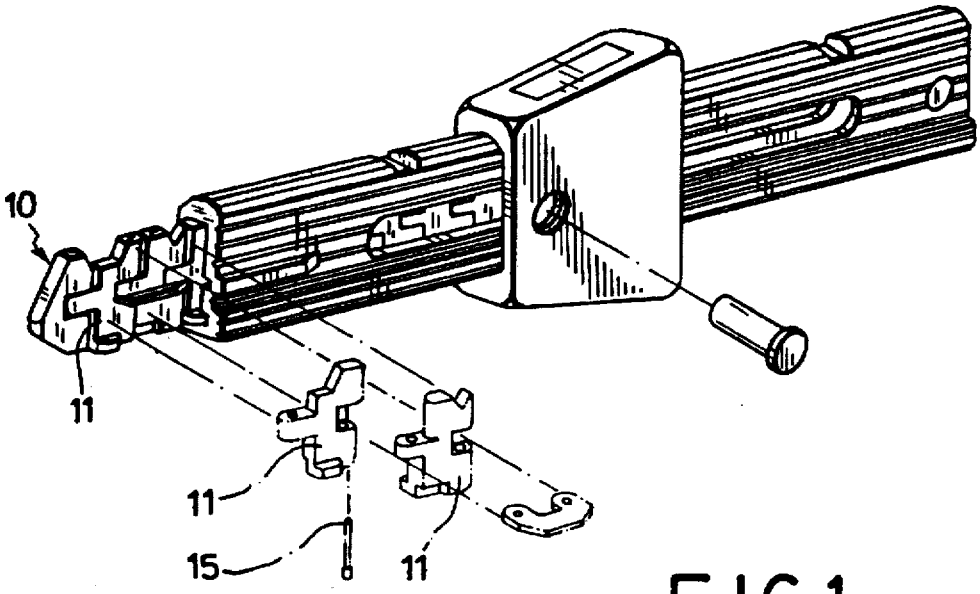
FIG.1 (PRIOR ART)
FIG. 1 is a perspective view of a flexible key for unlocking the lock of the lock assembly disclosed in U.S. Pat. No. 5,086,632.
Figure 2:
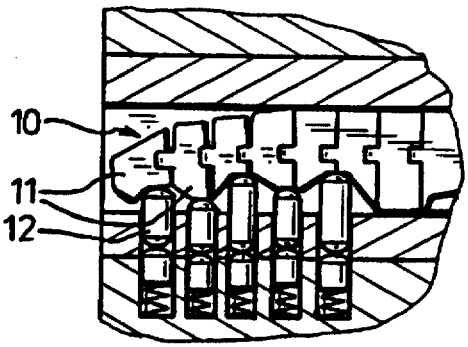
FIG.2 (PRIOR ART)
FIG. 2 is a sectional view illustrating the deformation of the flexible key in the lock of U.S. Pat. No. 5,086,632.
Figure 3:
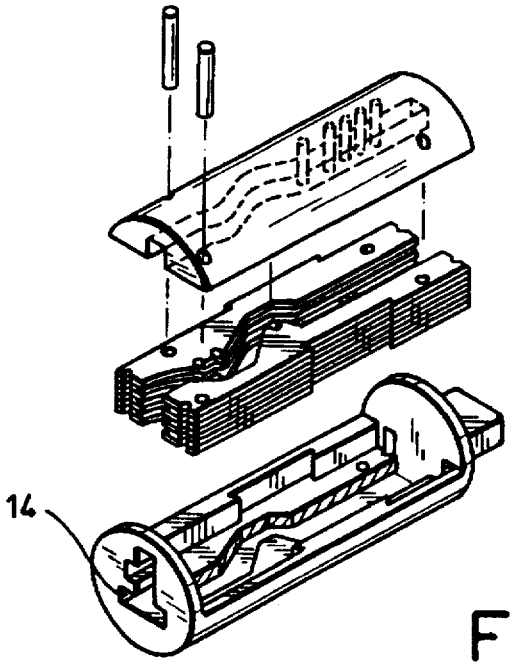
FIG.3 (PRIOR ART)
FIG. 3 is a partially exploded view of the plug unit within the lock of the lock assembly disclosed in U.S. Pat. No. 5,086,632.
Figure 4:
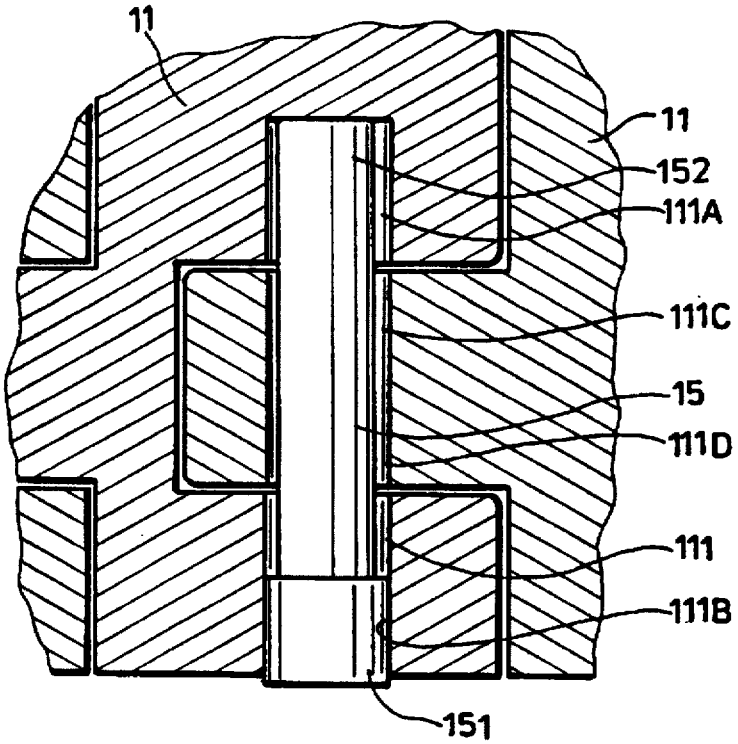
FIG.4 (PRIOR ART)
FIG. 4 is a sectional view, illustrating how an adjacent pair of knuckles are hinged together so as to form part of the key shown in FIG. 1.

Before the invention is described in greater detail, it should be noted that same reference numerals will be used to denote same elements throughout the disclosure.

Figure 5:
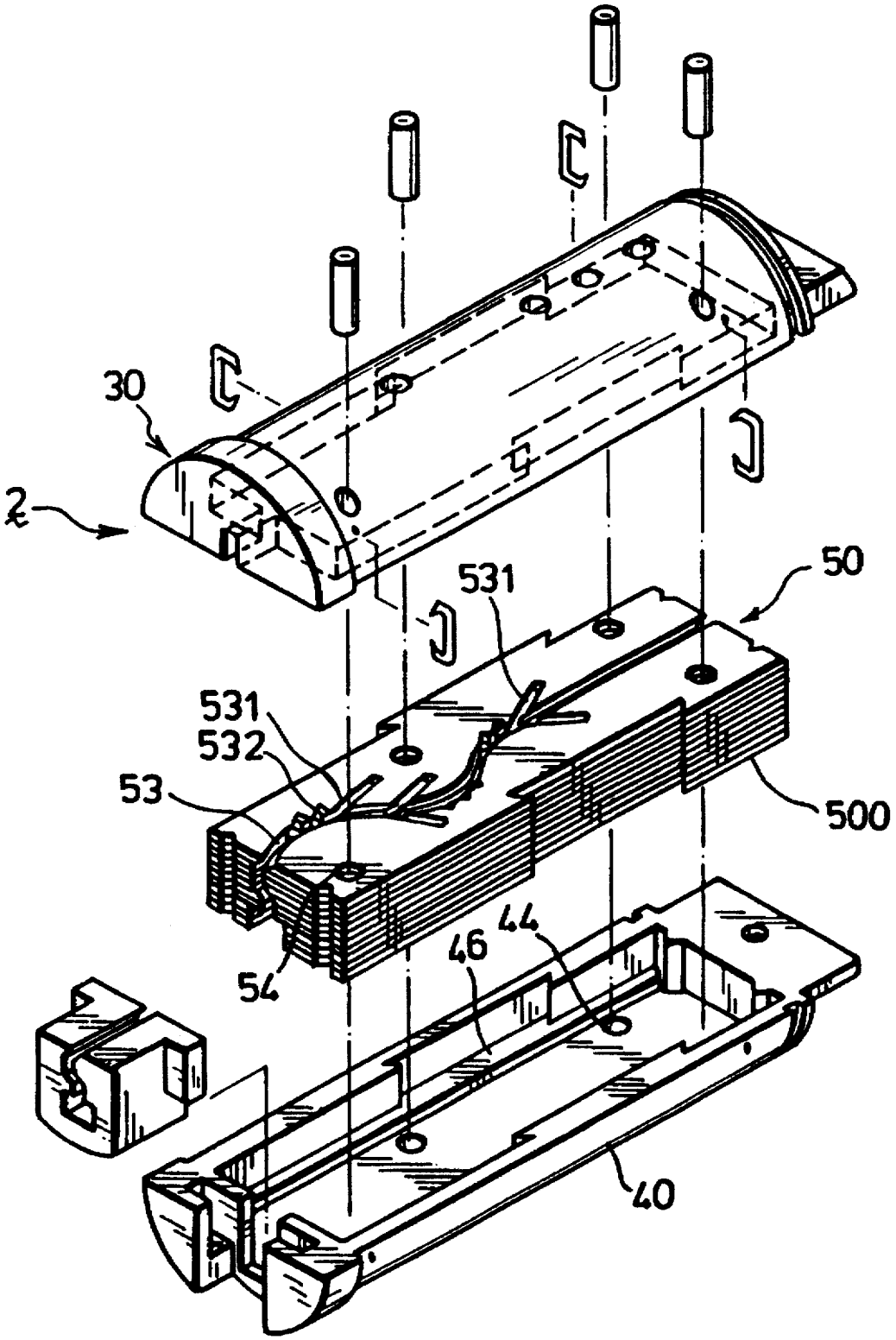
FIG. 5 is an exploded view of a first preferred embodiment of a plug unit of a lock assembly of this invention.
Figure 6:
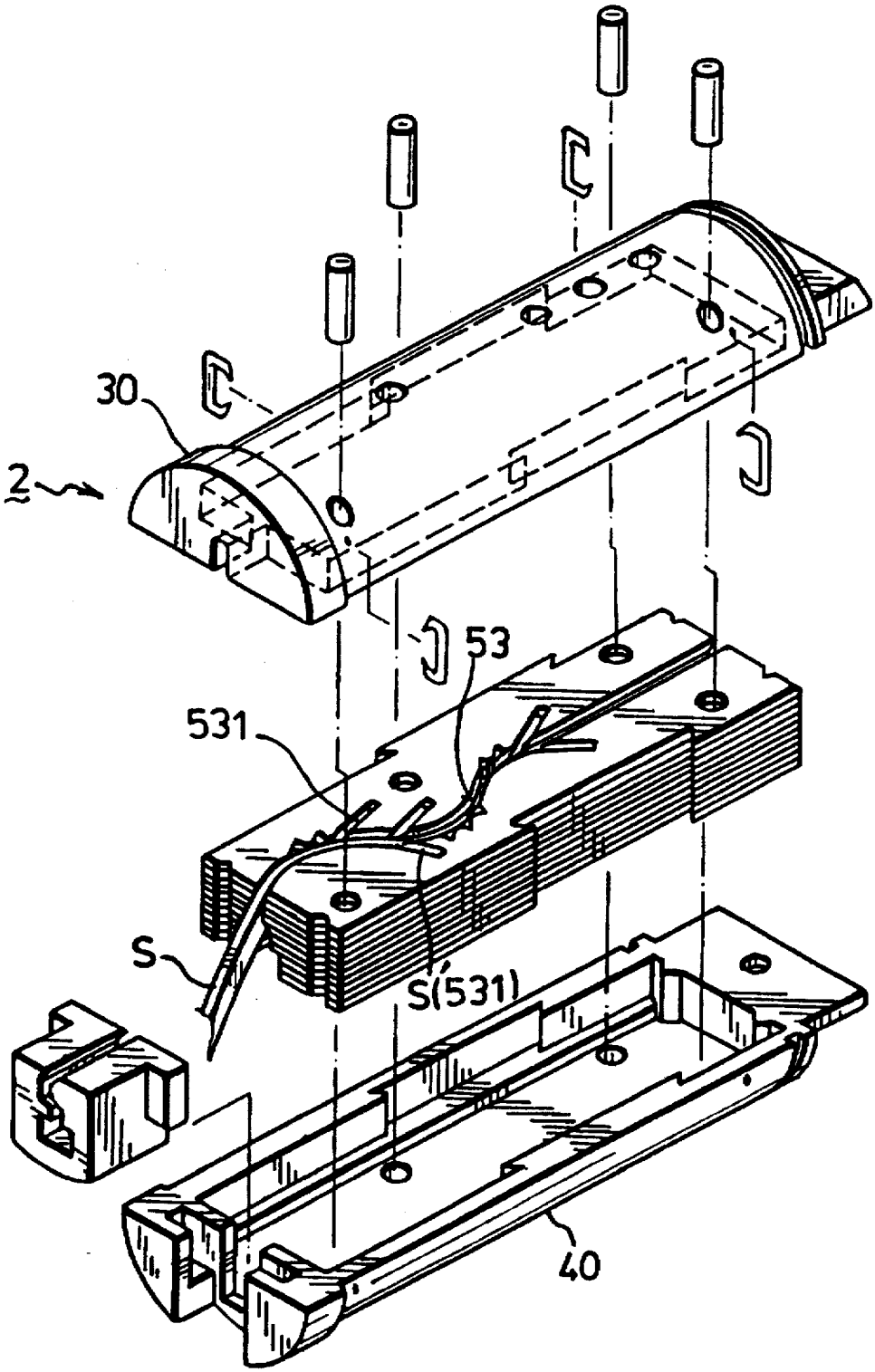
FIG. 6 illustrates how a flexible picking stick is prevented from picking the lock of the first preferred embodiment of this invention.

A lock assembly of this invention generally includes a lock and a flexible key 6 (see FIG. 10) for unlocking the lock. The lock includes an elongated plug unit mounted rotatably therein. As shown in FIG. 5, the plug unit 2 of the lock assembly includes two elongated lock pieces 30, 40, and a keyway member 50 confined between the lock pieces 30, 40. The keyway member 50 consists of two adjacent stacks of elongated metal sheets 500 and has a longitudinal curved keyway 53 with several turns. The keyway member 50 further has five straight branch slots 531 and several notches 532 formed in the inner side edges of the metal sheets 500. Each of the straight slots 531 extends from one of the turns of the keyway 53 in a direction different from that of a portion of the keyway 53 succeeding the turn. Thus, as best illustrated in FIG. 6, when a flexible stick (S) is inserted into the plug unit 2, the free end (S') of the stick (S) may be led into one of the slots 531, thereby preventing the stick (S) from extending through the keyway 53 in order to rotate the plug unit 2. Thus the lock is prevented from being easily picked.

Figure 7:
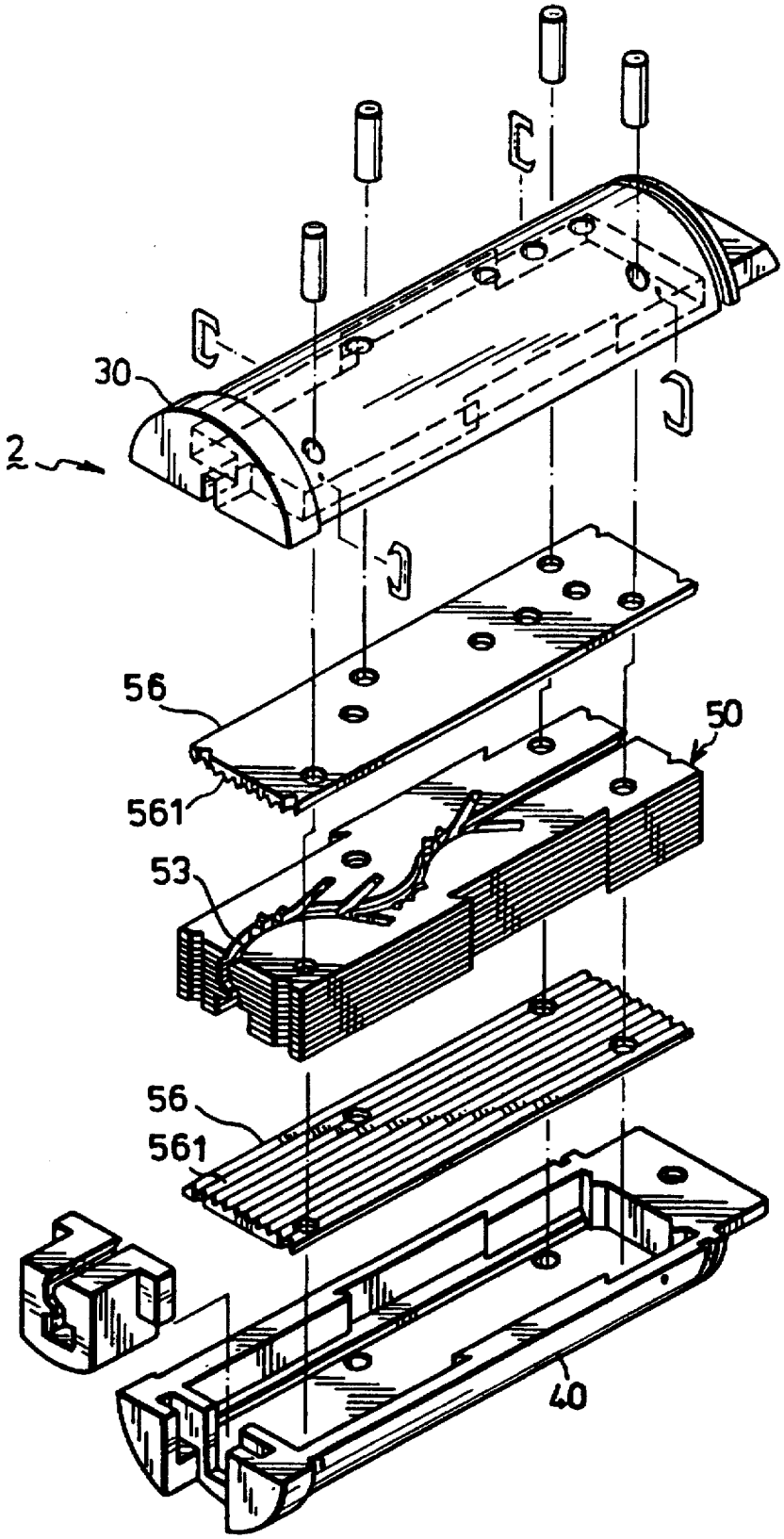
FIG. 7 is an exploded view showing a second preferred embodiment of the plug unit of the lock assembly of this invention.

As illustrated in FIG. 7, in one preferred embodiment of this invention, the lock pieces 30, 40 are respectively shaped in the form of two elongated cylinder halves. Each of the pieces 30, 40 is provided with an elongated abutting plate 56 attached thereto. Each of the plates 56 is formed with an abutting surface which abuts against the corresponding side surface of the keyway member 50 and which is formed with a plurality of lengthwise extending grooves 561 in communication with the keyway 53. Alternatively, the abutting plates 56 may be respectively and integrally formed with the cylinder halves 30, 40. When inserted into the keyway 53, the free end of the picking stick may engage one of the grooves 561, thereby preventing the stick from further advance in the keyway 53.

Figure 8:
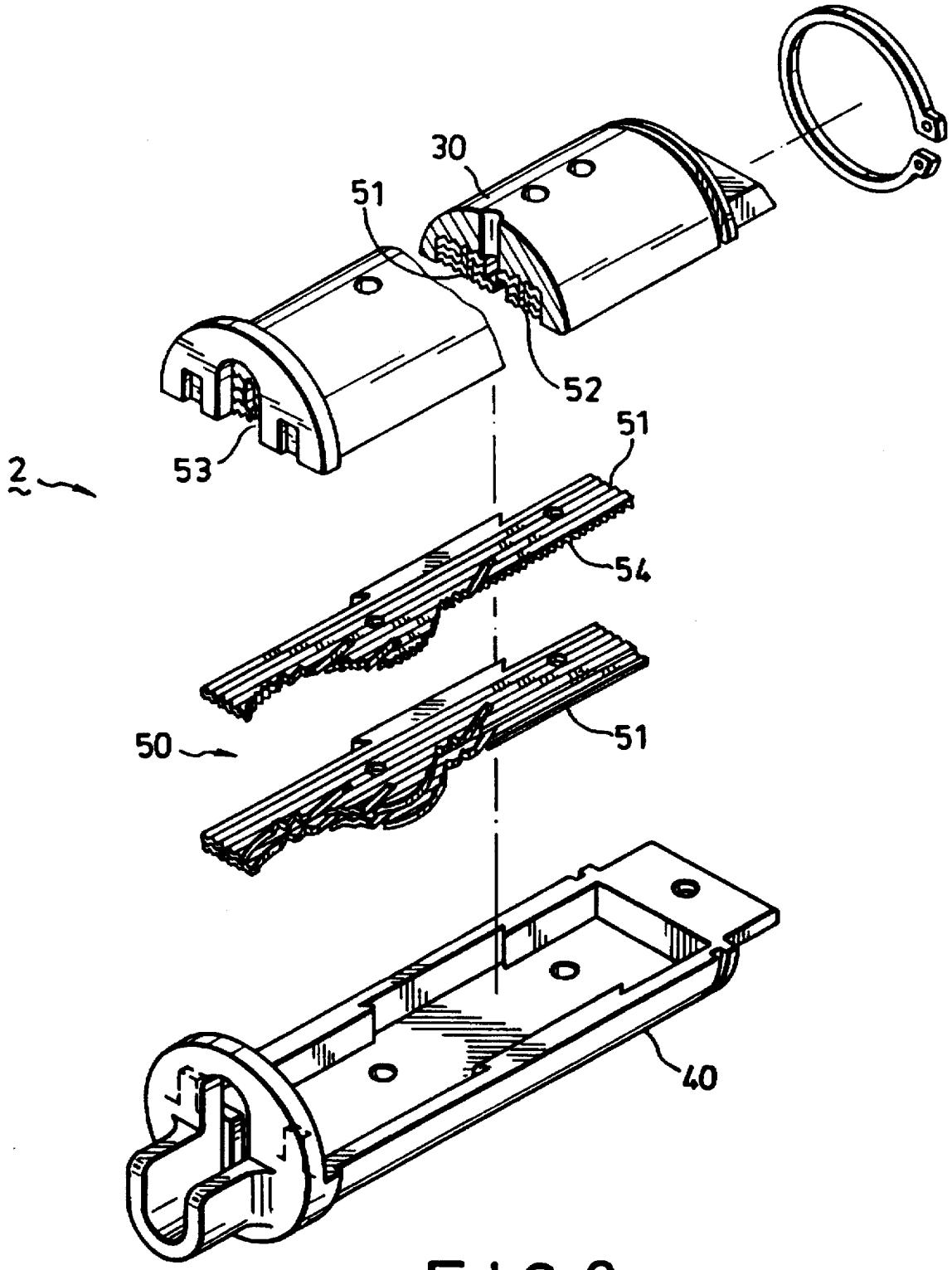
FIG. 8 is an exploded view of a third preferred embodiment of the plug unit of the lock assembly of this invention, wherein some of the metal sheets are removed for clarity.
Figure 8A:
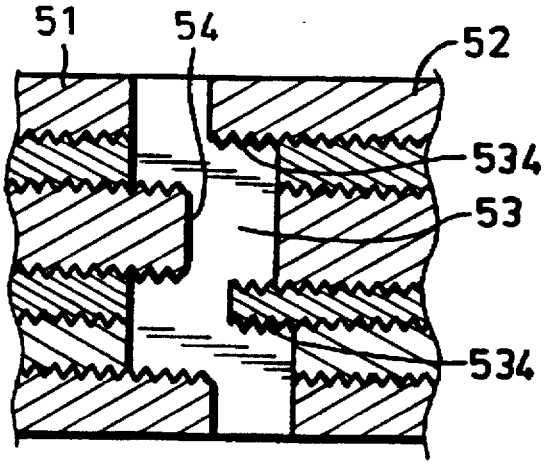
FIG. 8A is a sectional view illustrating the keyway formed in the fourth preferred embodiment of the plug unit according to this invention.

In each of the similar preferred embodiments, shown in FIGS. 8 and 8A, the keyway member 50 consists of two adjacent stacks of elongated metal sheets 51, 52 which have different thickness in the embodiment of FIG. 8A, and which cooperatively define the keyway 53 and the branch slots therebetween. Each of the sheets 51, 52 has serrated top and bottom surfaces which have a plurality of lengthwise extending grooves 534. One sheet 51 of the left stack has a serrated inner side edge 54 which extends into the keyway 53 and which is spaced apart from the right stack. The inner side edge 54 has a row of notches. When inserted into the keyway 53 of the plug unit, the picking stick can be misled into one of the notches of the inner side edge 54 so as to prevent the lock from being picked.

Figure 9:
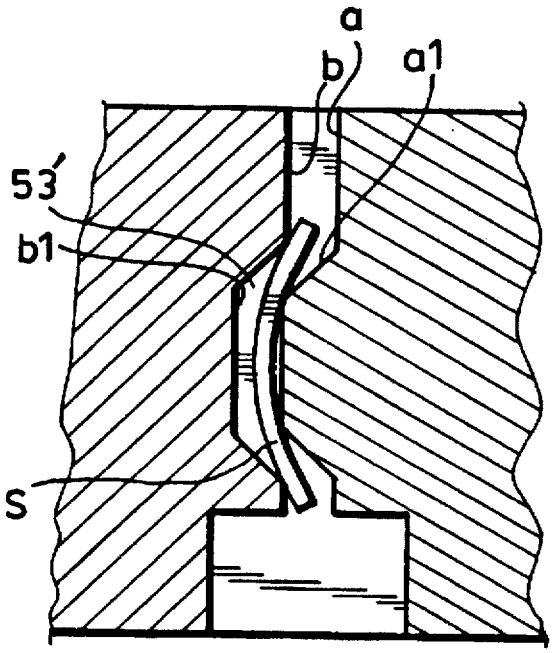
FIG. 9 illustrates how a picking stick is prevented from picking the fifth preferred embodiment of the lock of the lock assembly in accordance with this invention.

FIG. 9 is a cross sectional view of a modified keyway member in which the keyway 53' is defined between two inner side walls (a, b) of the keyway member. The wall (a) has a protrusion (a1) extending into the concave portion (b1) of the wall (b). As illustrated, when inserted into the keyway 53', the stick (S) flexes sideways to contact the walls (a, b), thereby causing difficulties in advancing the stick (S) further in the keyway 53'.

Figure 10:
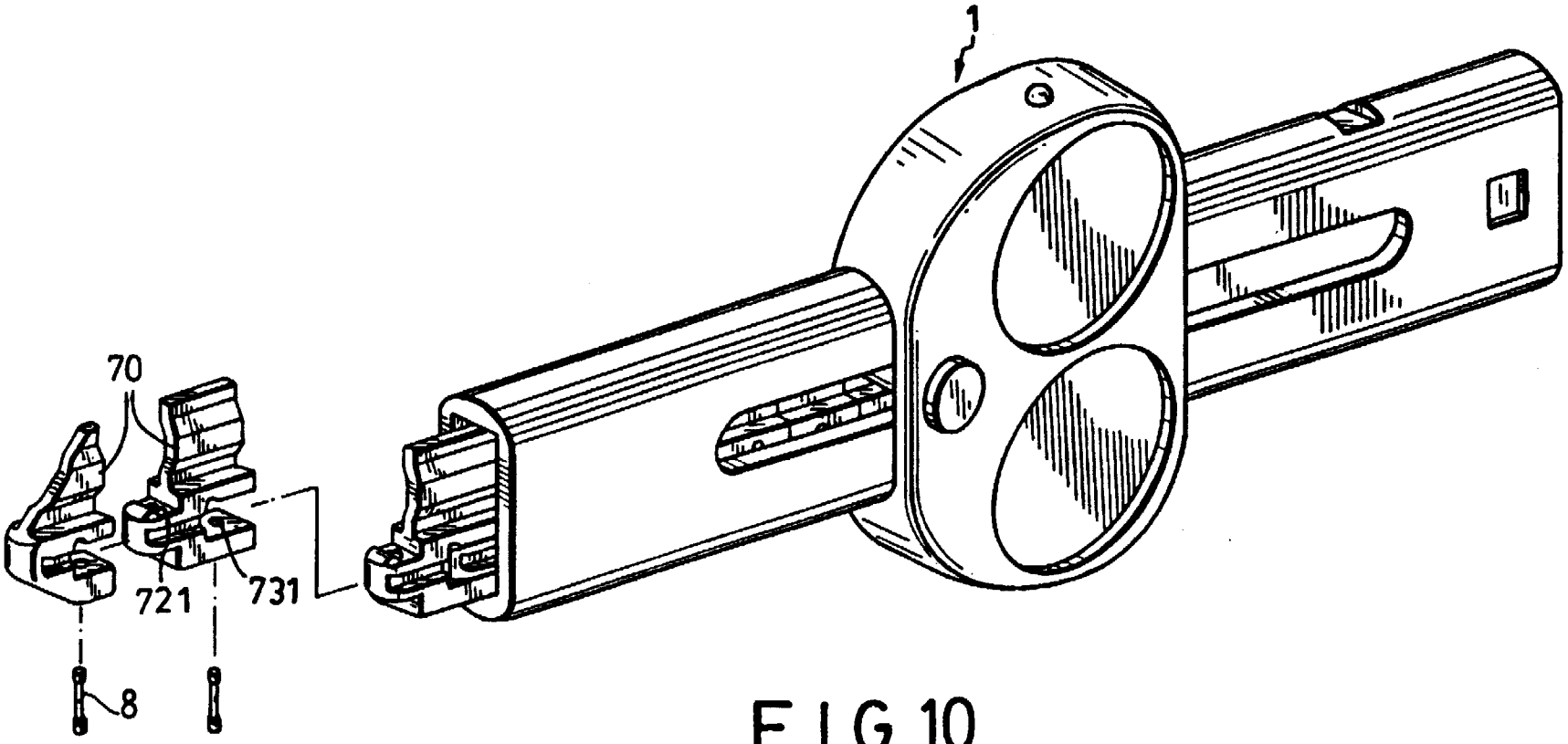
FIG. 10 is a partially exploded view showing a flexible key of the lock assembly of this invention.
Figure 11:
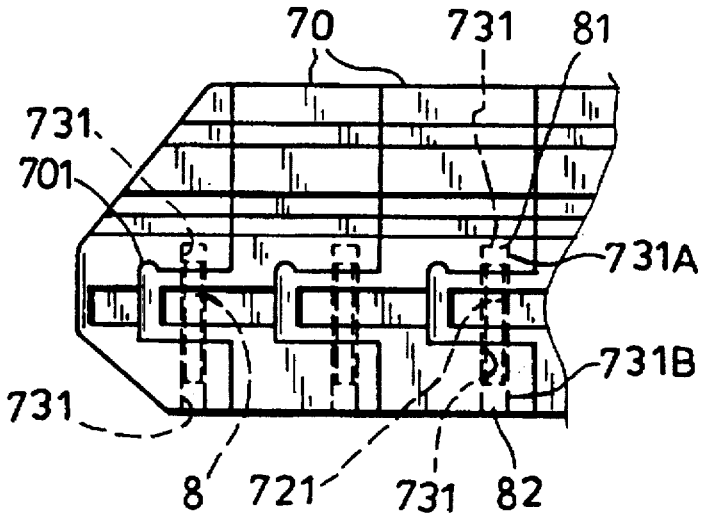
FIG. 11 illustrates how several knuckles are hinged together so as to form a chain of hinged knuckles of the flexible key according to this invention.
Figure 12:
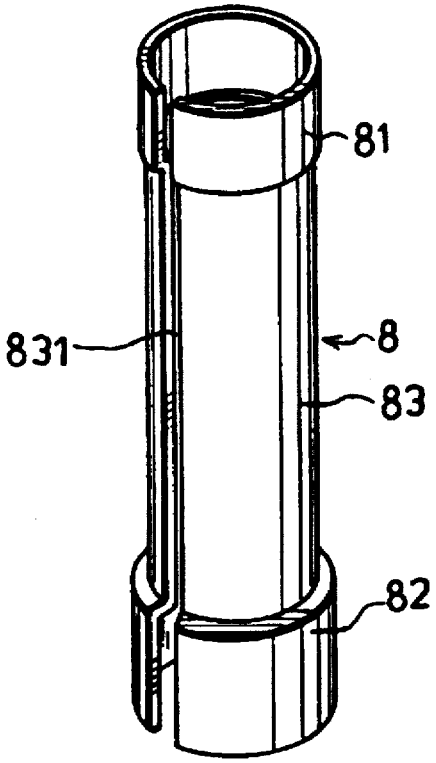
FIG. 12 shows a first type of pivot employed to hinge the knuckles shown in FIG. 11.

FIGS. 10, 11 and 12 illustrate a key 1 which can be inserted into the keyway of a lock of the lock assembly of this invention so as to unlock the lock. The flexible key 1 includes a chain of successively hinged knuckles 70 which can respectively rotate about parallel axes. Each of the knuckles 70 has a blind pivot hole unit 731 formed therein with a closed inner end section 731A and an open outer end section 731B, and an open-ended pivot hole unit 721 formed through the knuckle 70. The chain includes a plurality of circular tubular pivots 8. Each of the pivots 8 interconnects an adjacent pair of the knuckles 70 and has an enlarged inner end portion 81 that is press-fitted within the inner end section 731A of the blind pivot hole unit 731 of one of the knuckles 70, an enlarged outer end portion 82 that is press-fitted within the outer end section 731B of the blind pivot hole unit 731 of the one of the knuckles 70, and an intermediate portion 83 that interconnects the enlarged inner and outer end portions 81, 82 and that extends through the open-ended pivot hole unit 721 of another one of the knuckles 70. The enlarged outer end portion 82 has a greatest diameter slightly larger than that of the enlarged inner end portion 81 of the pivot 8. The intermediate portion 83 of each of the pivots 8 has a diameter smaller than that of the enlarged inner end portions 81 and than that of the open-ended pivot hole units 721 of the knuckles 70 to assist in relative rotation of any adjacent pair of knuckles 70.

Each of the pivots 8 is preferably made of a spring steel which has an axially extending slot 831 extending along the total length thereof. Thus, the pivot 8 can retract radially and inwardly to assist in insertion of the pivot 8 into the blind pivot hole unit 731 of the knuckle 70.

Figure 13:
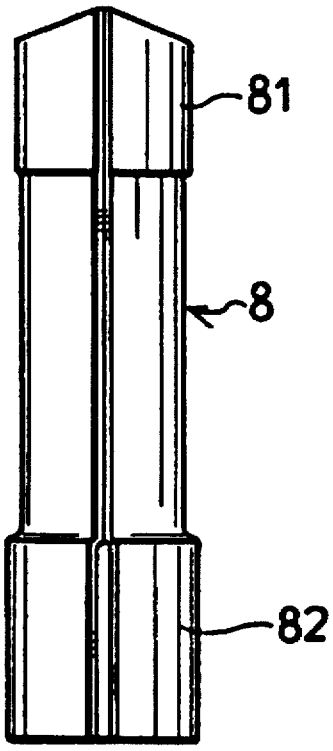
FIG. 13 shows a second type of pivot employed to hinge the knuckles shown in FIG. 11.
Figure 14:
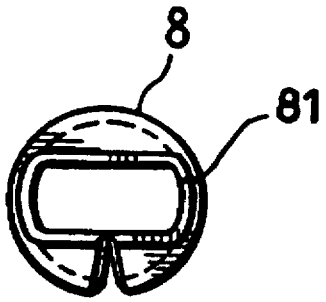
FIG. 14 is a cross sectional view of the second type of pivot employed to hinge the knuckles shown in FIG. 11.

Referring to FIGS. 13 and 14, a modified pivot 8 has an enlarged inner end portion 81 of oval-shaped cross section to assist in insertion of the pivot 8 into the blind pivot hole unit of the knuckle.

Figure 15:
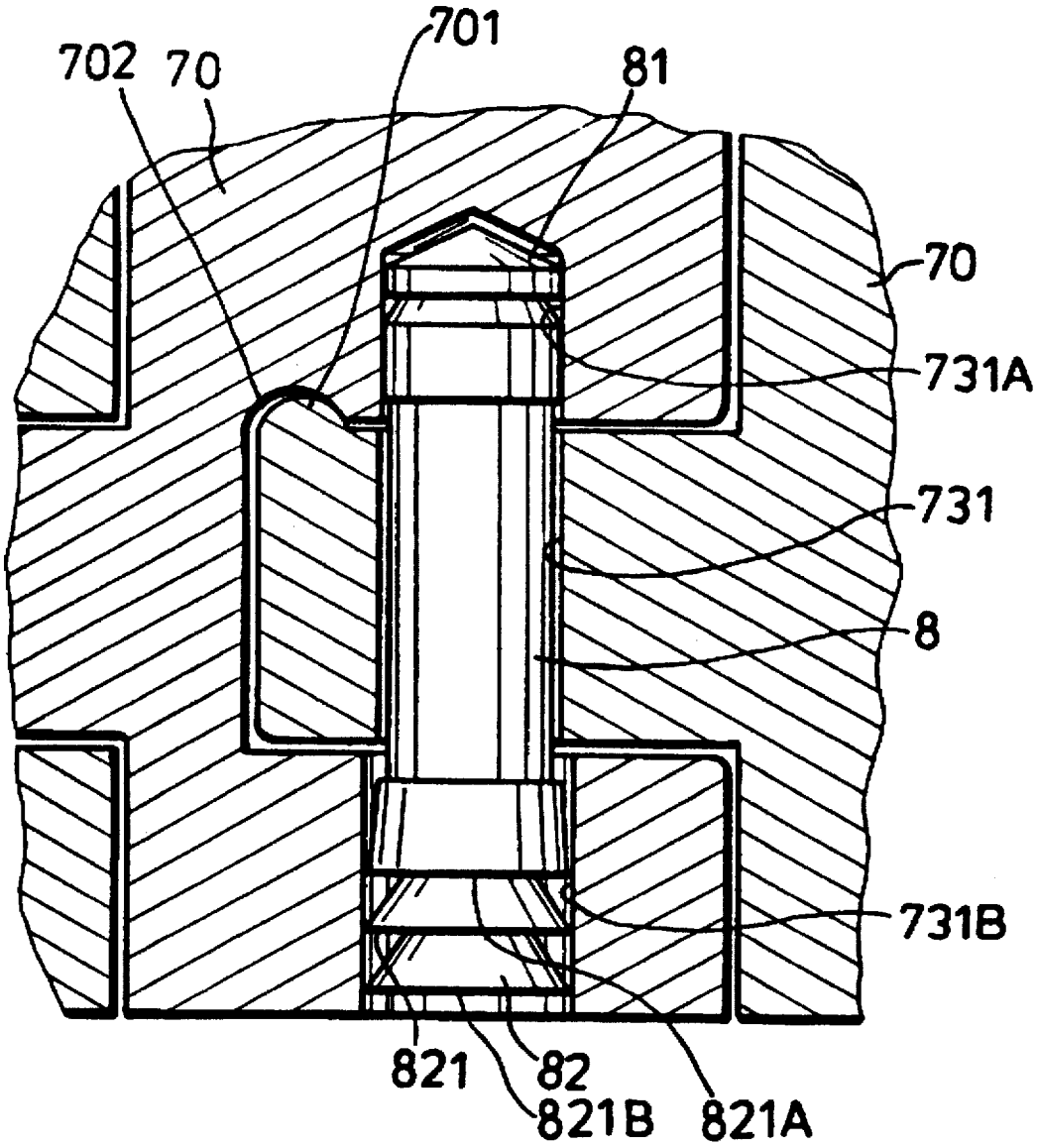
FIG. 15 illustrates how an adjacent pair of knuckles are hinged together by a third type of pivot of this invention.

Referring to FIG. 15, in another embodiment, the inner end section 731A and the outer end section 731B of each of the blind pivot hole units 731 of the knuckles 70 have different diameters, in such a manner that the diameter of the inner end section 731A is smaller than that of the outer end section 731B. Each of the enlarged inner and outer end portions 81, 82 of the pivots 8 includes a plurality of truncated conical sections 821, each of which has a smallest diameter at an inner end 821A thereof, and a greatest diameter at an outer end 821B thereof. The outer ends 821B of the enlarged inner and outer end portions 82 of the pivots 8 respectively abut against walls of the knuckles 70 which define the blind pivot hole units 731 so as to achieve easy insertion of the pivots 8 into the blind pivot hole units 731 and so as to prevent disengagement of the pivots 8 from the blind pivot hole units 731.

Referring to FIGS. 11 and 15, each of the knuckles 70 is formed with a dovetail joint 701 and a dovetail groove 702 which engages the dovetail joint 701 of another one of the knuckles 70, so as to reduce relative movement between the knuckles 70 in a direction perpendicular to the axis of the pivots 8, thereby minimizing the deformation of the key.

With the present invention thus explained, it is obvious to those skilled in the art that various modifications and variations can be made without departing from the scope and spirit thereof. It is therefore intended that the invention be limited only as in the appended claims.

What is claimed is:

1. A lock assembly including a lock and a flexible key for actuating said lock, said lock including an elongated plug unit that is mounted rotatably in said lock and that has a longitudinal curved keyway accessible by said key, said keyway having several turns, said plug unit further having several branch slots each of which extends from a respective one of the turns of said curved keyway in a direction different from that of a portion of said curved keyway succeeding the respective one of the turns so as to mislead an undesirable flexible stick into said slot, thereby preventing said lock from being picked by the flexible stick, said plug unit including a keyway member having said curved keyway and said slots formed therethrough, and two elongated lock pieces which are shaped in the form of two elongated cylinder halves and which cooperatively confine said keyway member therebetween, said keyway member having two planar opposite side surfaces, each of said cylinder halves having an abutting surface which abuts against one of said side surfaces of said keyway member and which is formed with a plurality of lengthwise extending grooves therein in communication with said keyway and said slots, said keyway member including two adjacent stacks of elongated metal sheets between which said keyway and said slots are defined.

2. The lock assembly as defined in claim 1, wherein each of said sheets has serrated top and bottom surfaces each of which is formed with a plurality of lengthwise extending grooves, one of said sheets in one of the stacks having an inner side portion which extends into said keyway and which is spaced apart from the other one of said stacks of said sheets, whereby, when inserted into said keyway of said plug unit, the picking stick can be misled into one of said lengthwise extending grooves of said inner side portions of said sheets so as to prevent said lock from being picked by the stick.

3. The lock assembly as defined in claim 1, wherein each of said sheets has serrated top and bottom surfaces each of which is formed with a plurality of lengthwise extending grooves, one of said sheets in one of the stacks having a serrated inner side edge which extends into said keyway and which is spaced apart from the other one of the stacks of said sheets, said serrated inner side edge having a row of notches, whereby, when inserted into said keyway of said plug unit, the picking stick can be misled into one of said notches so as to prevent said lock from being picked by said stick.

4. A lock assembly including a lock and a flexible key for actuating said lock, said lock including an elongated plug unit that is mounted rotatably in said lock and that has a longitudinal curved keyway accessible by said key, said keyway having several turns, said plug unit further having several branch slots each of which extends from a respective one of the turns of said curved keyway in a direction different from that of a portion of said curved keyway succeeding the respective one of the turns so as to mislead an undesirable flexible stick into said slot, thereby preventing said lock from being picked by the flexible stick, wherein said flexible key includes a chain of successively hinged knuckles having parallel rotating axes, each of said knuckles having a blind pivot hole unit formed therein with a closed inner end section and an open outer end section, and an open-ended pivot hole unit formed through said knuckle, said chain including a plurality of tubular pivots, each of which interconnects an adjacent pair of said knuckles and each of which has an enlarged inner end portion that is received within said inner end section of said blind pivot hole unit of one of said knuckles in such a manner that said enlarged inner end portion has a section which is press-fitted within said inner end section of said blind pivot hole unit of the one of said knuckles, an enlarged outer end portion that is press-fitted within said outer end section of said blind pivot hole unit of said one of said knuckles and having a greatest diameter slightly larger than that of said enlarged inner end portion of said pivot, and an intermediate portion that interconnects said enlarged inner and outer end portions and that extends through said open-ended pivot hole unit of another one of said knuckles, said intermediate portion of each of said pivots having a diameter smaller than that of said enlarged inner end portions of said pivots and than that of said open-ended pivot hole units of said knuckles to assist in relative rotation of any adjacent pair of knuckles.

5. The lock assembly as defined in claim 4, wherein each of said pivots is made of a spring steel and is shaped in the form of a circular tube which has an axially extending slot extending over a total length thereof so as to assist in insertion of said pivot into one of said blind pivot hole units of said knuckles.

6. The lock assembly as claimed in claim 4, wherein said inner and outer end sections of each of said blind pivot hole units of said knuckles have different diameters in such a manner that the diameter of said inner end section is smaller than that of said outer end section, each of said enlarged inner and outer end portions of said pivots including a plurality of truncated conical sections, each of which has a smallest diameter at an inner end thereof, and a greatest diameter at an outer end thereof, said enlarged inner and outer end portions of said pivots respectively abutting against walls of said knuckles which define said blind pivot hole units so as to facilitate insertion of said pivots into said blind pivot hole units and so as to prevent disengagement of said pivots from said blind pivot hole units.

7. A lock assembly including a lock and a flexible key for actuating the lock, the lock including an elongated plug unit that is mounted rotatably in the lock and that has a longitudinal curved keyway accessible by the key, the keyway having several turns, the plug unit further including a keyway member having the curved keyway, and two elongated lock pieces which are shaped respectively in the form of two elongated cylinder halves and which cooperate to confine the keyway member therebetween, said keyway member further having several branch slots formed therethrough in communication with said keyway, said keyway member being formed by two adjacent stacks of elongated metal sheets which define the keyway and the slots therebetween and which have two planar opposite side faces, each of the cylinder halves having an abutting surface which abuts against one of the side surfaces of the keyway member.

8. The lock assembly as defined in claim 7, wherein each of said branch slots extends from a respective one of the turns of the curved keyway in a direction different from that of a portion of the curved keyway succeeding the respective one of the turns so as to mislead an undesirable flexible stick into the slot, thereby preventing the lock from being picked by the flexible stick.

9. The lock assembly as defined in claim 7, wherein the abutting surface of the respective one of said cylinder halves is formed with a plurality of lengthwise extending grooves therein in communication with the keyway and the slots.

* * * * *